US008832943B2

(12) United States Patent
Sakai

(10) Patent No.: US 8,832,943 B2
(45) Date of Patent: Sep. 16, 2014

(54) RETRACTABLE SCISSORS

(75) Inventor: Kimiyuki Sakai, Seki (JP)

(73) Assignee: Gerber Sakai Co., Ltd., Seki-shi (JP)

( * ) Notice: Subject to any disclaimer, the term of this patent is extended or adjusted under 35 U.S.C. 154(b) by 178 days.

(21) Appl. No.: 13/532,974

(22) Filed: Jun. 26, 2012

(65) Prior Publication Data

US 2013/0340258 A1 Dec. 26, 2013

(51) Int. Cl.
*B26B 13/22* (2006.01)

(52) U.S. Cl.
USPC ..... 30/146; 30/122; 30/143

(58) Field of Classification Search
CPC .... B26B 11/005; B26B 11/006; B26B 13/22; B26B 1/02; B26B 1/04; B26B 1/042
USPC ..... 30/122, 146, 155–161, 255, 256, 143
See application file for complete search history.

(56) References Cited

U.S. PATENT DOCUMENTS

| | | | | | |
|---|---|---|---|---|---|
| 568,010 | A * | 9/1896 | Wilkins | 30/186 |
| 826,569 | A * | 7/1906 | Hanson | 86/22 |
| 1,194,486 | A * | 8/1916 | Downs | 86/22 |
| 1,298,166 | A * | 3/1919 | Borszcz | 30/146 |
| 1,303,277 | A * | 5/1919 | Federkiewicz et al. | 30/146 |
| 1,345,882 | A * | 7/1920 | Repass | 30/233 |
| 1,454,994 | A * | 5/1923 | De Matteo | 30/112 |
| 2,319,607 | A * | 5/1943 | Kevorkian et al. | 30/345 |
| 2,674,796 | A * | 4/1954 | Herold | 30/262 |
| 3,835,533 | A * | 9/1974 | Granson | 30/146 |
| 5,255,438 | A * | 10/1993 | Morgan | 30/254 |
| 6,698,099 | B2 * | 3/2004 | Ronan et al. | 30/122 |
| 6,877,229 | B2 | 4/2005 | Sakai | |
| 7,062,856 | B2 * | 6/2006 | Moser | 30/160 |

FOREIGN PATENT DOCUMENTS

| | | |
|---|---|---|
| JP | A-2000-153081 | 6/2000 |

* cited by examiner

*Primary Examiner* — Hwei C Payer
(74) *Attorney, Agent, or Firm* — Posz Law Group, PLC

(57) ABSTRACT

Retractable scissors include a holder and a scissor piece mounted on the holder. The scissor piece is rotational with respect to the holder among a closed position, at which the scissor piece is retracted in the holder, a first open position, at which the scissor piece is open with respect to the holder at an acute angle, and a second open position, at which the scissor piece is open with respect to the holder wider than at the first open position. The scissor piece includes a first edge, and the holder includes a second edge that intersects and contacts the first edge. When the scissor piece is rotated with respect to the holder from the first open position toward the closed position, the scissor piece and the holder cooperate to function as a pair of scissors that cuts an object between the first and second edges. When the scissor piece is located at the second open position, the scissor piece functions as a blade of a knife, and the holder functions as a handle of the knife.

11 Claims, 3 Drawing Sheets

RETRACTABLE SCISSORS

BACKGROUND OF THE INVENTION

The present invention relates to retractable scissors.

Japanese Laid-Open Patent Publication No. 2000-153081 discloses retractable scissors that include a holder and two blades, which are interlocked with each other and are supported on the holder to rotate between a non-use position and a use position. According to the retractable scissors disclosed in the above publication, two blades (scissor pieces) are retracted in the holder in a state where the blades are in the non-use position, and project from the holder to be able to function as a pair of scissors when the blades are at the use position.

The retractable scissors of the above publication require three components including the holder and the two blades as main components.

Also, U.S. Pat. No. 6,877,229 of the present inventor discloses a foldable knife having a function of scissors. The foldable knife includes a handle and first and second blades, which are supported by the handle to rotate independently from each other between the non-use position, where each blade is retracted in the handle, and the use position, where each blade extends from the handle. When the second blade is located at the non-use position and the first blade is located at the use position, the first blade functions as a knife. When the first and second blades are located at the use position, the blades cooperate with each other to function as a pair of scissors.

Like the retractable scissors of Japanese Laid-Open Patent Publication No. 2000-153081, the foldable knife of the above-mentioned U.S. Pat. No. 6,877,229 also requires three components, which are the handle and the two blades, as the main components.

SUMMARY OF THE INVENTION

The articles disclosed in the above publications all require two blades that are retractable in the holder or the handle to function as a pair of scissors. In contrast, the objective of the present invention is to provide retractable scissors that have a simple structure as compared to the articles disclosed in the above publications.

To achieve the foregoing objective, the present invention provides a retractable scissors that includes a holder and a scissor piece. The scissor piece is mounted on the holder and is rotational with respect to the holder between a closed position, at which the scissor piece is retracted in the holder, and an open position, at which the scissor piece is open with respect to the holder. The scissor piece includes a first edge. The holder includes a second edge that intersects and contacts the first edge. When the scissor piece is rotated with respect to the holder from the open position toward the closed position, the scissor piece and the holder cooperates to function as a pair of scissors that outs an object between the first and second edges.

In accordance with one aspect of the present invention, a retractable scissors that includes a holder and a scissor piece is provided. The holder includes first and second side walls, which face each other to define an accommodation groove therebetween. The scissor piece is mounted on a distal end of the holder, and is rotational with respect to the holder among a closed position, at which the scissor piece is retracted in the accommodation groove, a first open position, at which the scissor piece is open with respect to the holder at an acute angle, and a second open position, at which the scissor piece is open with respect to the holder wider than at the first open position. The scissor piece includes a first edge. The holder includes a second edge that intersects and contacts the first edge. The second edge is provided on the first side wall and defines part of an opening rim of the accommodation groove. When the scissor piece is rotated with respect to the holder from the first open positron toward the closed position, the scissor piece and the holder cooperate to function as a pair of scissors that cuts an object between the first and second edges. When the scissor piece is located at the second open position, the scissor piece functions as a blade of a knife, and the holder functions as a handle of the knife.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DESCRIPTION OF THE PREFERRED EMBODIMENTS

Figure 1:
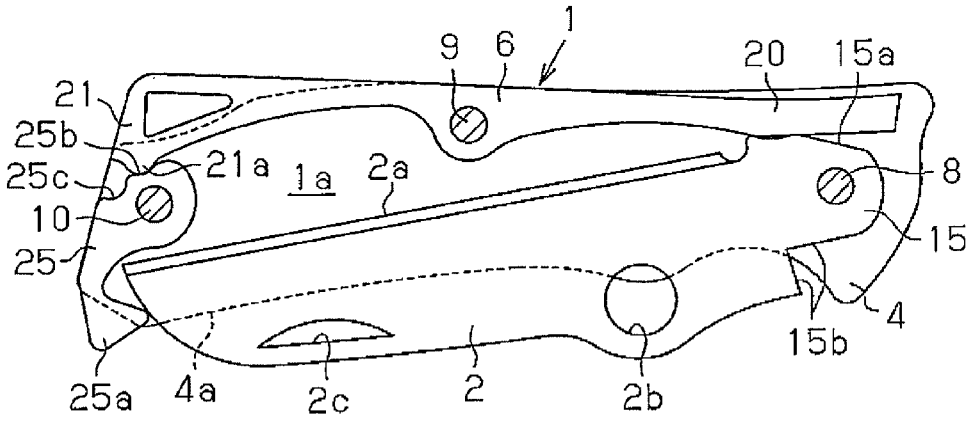
FIG. 1 is a front cross-sectional view illustrating retractable scissors according to one embodiment of the present invention with a second side wall removed, showing the state where a scissor piece is located at a closed position.

One embodiment of the present invention will now be described with reference to FIGS. 1 to 5. The retractable scissors of the present embodiment looks like just a foldable knife at first sight, but has the functions of scissors and knife as described below. The retractable scissors of the present embodiment may be referred to as a foldable knife having a function of scissors.

As shown in FIGS. 1 to 4, the retractable scissors include a holder 1 having an accommodation groove 1*a*, and a scissor piece 2 rotatably mounted on the distal end of the holder 1. The scissor piece 2 is rotational among a closed position (see FIG. 1), at which the scissor piece 2 is retracted in the holder 1, or more specifically, at which the scissor piece 2 is retracted in the accommodation groove 1*a*, a first open position (see FIG. 2), at which the scissor piece 2 is open with respect to the holder 1 at an acute angle, and a second open position (see FIG. 3), at which the scissor piece 2 is open with respect to the holder 1 wider than at the first open position. At the second open position, the scissor piece 2 is open with respect to the holder 1 at substantially 180 degrees (that is, the scissor piece 2 extends along the longitudinal axis of the holder 1).

The scissor piece 2 is formed of a hard material such as a metallic material or ceramics, and includes a first edge 2*a*, which extends along the longitudinal direction of the scissor piece 2. The first edge 2*a* is sharpened enough to function as a blade of a knife.

The holder 1 includes first and second side walls 4, 5 that face each other and a spine 6 mounted between the upper edges of the side walls 4, 5. The side walls 4, 5, which form the main body of the holder 1, are coupled to each other by first, second, and third connecting pins 8, 9, 10 with the spine 6 sandwiched in between. The side walls 4, 5, and the spine 6 define the accommodation groove 1*a*. The spine 6 has substantially the same thickness as the scissor piece 2.

Figure 2:
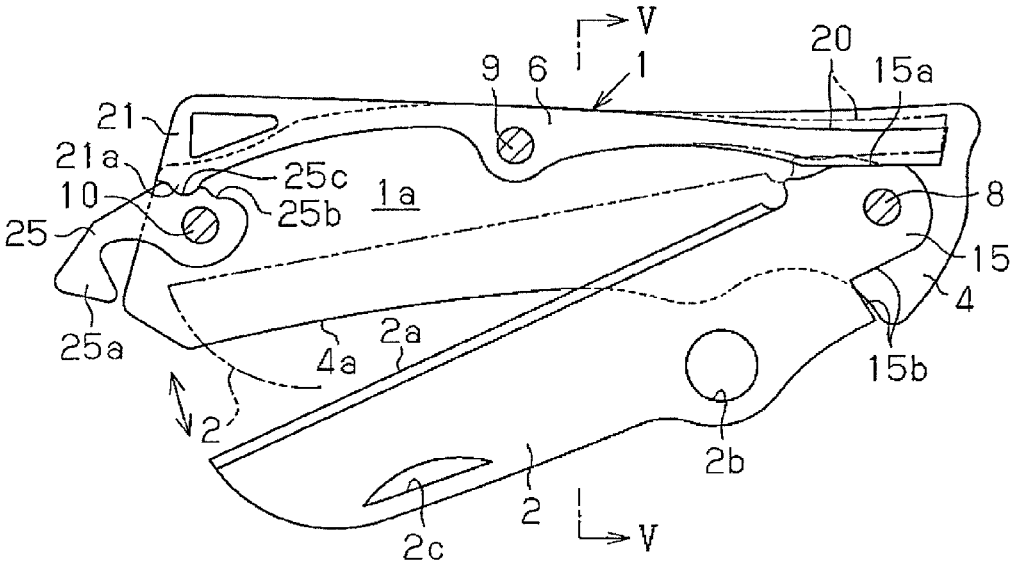
FIG. 2 is a front cross-sectional view illustrating the scissors of FIG. 1, showing the state where the scissor piece is located at a first open position.
Figure 5:
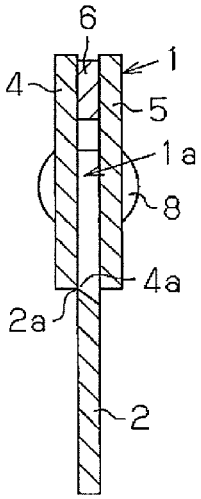
FIG. 5 is a cross-sectional view taken along line V-V of FIG. 2.

The first and second side walls 4, 5 are formed of a hard material such as a metallic material or ceramics, and the spine 6 is made of an elastic material, preferably a metallic material. As shown in FIGS. 2 and 5, the holder 1 includes a second edge 4*a*, which intersects and contacts the first edge 2*a* of the scissor piece 2. More specifically, the second edge 4*a* is provided on the first side wall 4, and defines part of the opening rim of the accommodation groove 1*a*. In other words, a region of the first side wall 4 defining the opening rim of the accommodation groove 1*a* forms the second edge 4*a*. The second edge 4*a* is formed to be able to cut an object at least between the second edge 4*a* and the first edge 2*a* of the scissor piece 2, and does not need to be sharpened enough to function as a blade of a knife.

As shown in FIGS. 1 to 4, the first connecting pin 8 extends through the side walls 4, 5 at the distal end of the holder 1. The second connecting pin 9 extends through the side walls 4, 5, and the spine 6 at the longitudinal middle part of the holder 1. The third connecting pin 10 extends through the side walls 4, 5 at the proximal end of the holder 1. The distal end and the proximal end of the spine 6 are free ends.

The first connecting pin 8 functions as a supporting shaft, which supports the scissor piece 2 such that the scissor piece 2 is rotational with respect to the holder 1. The scissor piece 2 includes, at its proximal end, a tongue 15, which is rotatably supported by the first connecting pin 8, or the supporting shaft 8. The axis of the supporting shaft 8 is a pivotal axis of the scissor piece 2. The tongue 15 is always arranged in the accommodation groove 1*a*, and is held between the side walls 4, 5.

Figure 3:
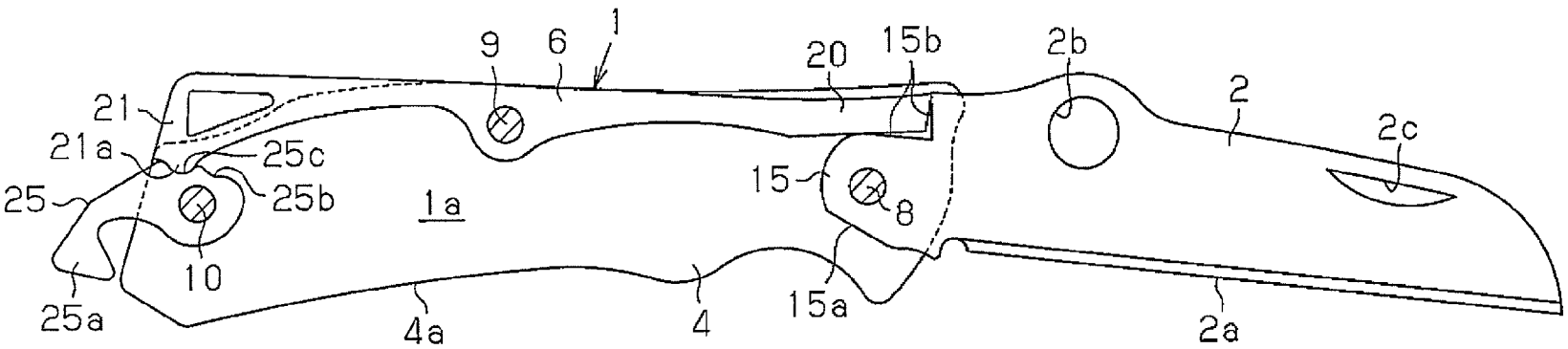
FIG. 3 is a front cross-sectional view illustrating the scissors of FIG. 1, showing the state where the scissor piece is located at a second open position.
Figure 4:
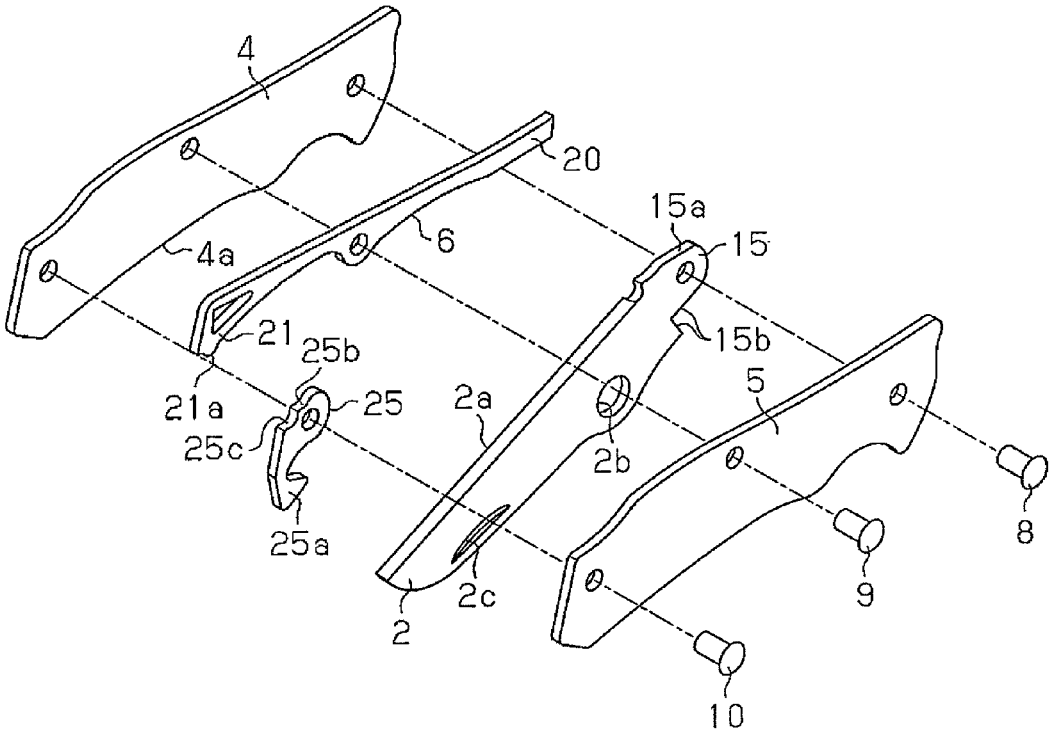
FIG. 4 is an exploded perspective view illustrating the scissors of FIG. 1.

As shown in FIGS. 1 to 3, the distal end (free end) of the spine 6 functions as a first engaging portion 20 engaging with the outer edge of the tongue 15. The first engaging portion 20 is a spring, which elastically presses the outer edge of the tongue 15. As shown in FIG. 1, in the state where the scissor piece 2 is located at the closed position, the first engaging portion 20 presses the tongue 15 such that it may apply to the scissor piece 2 a turning force toward the first open position from the closed position (a counterclockwise force in FIG. 1). That is, the first engaging portion 20 functions as an urging member that urges the scissor piece 2 from the closed position in FIG. 1 to the first open position in FIG. 2.

As shown in FIGS. 1 to 3, a latch member 25 is located between the proximal ends of the side walls 4, 5, and is supported by the third connecting pin 10 to be rotational with respect to the holder 1. The latch member 25 is detachably engaged with the scissor piece 2 such that the scissor piece 2 is held at the closed position of FIG. 1. More specifically, the latch member 25 has a hook 25*a* at the distal end portion. The latch member 25 is rotational between an engaging position (see FIG. 1), at which the hook 25*a* is engaged with the distal end of the scissor piece 2, and a release position (see FIG. 2), at which the hook 25*a* is disengaged from the scissor piece 2.

As shown in FIG. 1, when the latch member 25 is located at the engaging position in a state where the scissor piece 2 is located at the closed position, the hook 25*a* is engaged with the distal end of the scissor piece 2, and the scissor piece 2 is held at the closed position against the pressure elastically applied by the first engaging portion 20 of the spine 6. When the latch member 25 is rotated from this state to the release position of FIG. 2, the hook 25*a* is disengaged from the distal end of the scissor piece 2. As a result, the scissor piece 2 is rotated to the first open position of FIG. 2 by the pressure elastically applied by the first engaging portion 20. At the first open position, the first engaging portion 20 is elastically engaged with a flat portion 15*a* at the outer edge of the tongue 15. Thus, the scissor piece 2 is elastically held at the first open position.

A first receiving recess 25*b* and a second receiving recess 25*c* are formed at the outer edge of the proximal end of the latch member 25. The proximal end (free end) of the spine 6 functions as a second engaging portion (spring portion) 21, which is elastically engaged with the outer edge of the proximal end of the latch member 25. The second engaging portion 21 includes a projection 21*a*, which is selectively engaged with the first receiving recess 25*b* and the second receiving recess 25*c*. When the latch member 25 is located at the engaging position of FIG. 1, the projection 21*a* of the second engaging portion 21 is engaged with the first receiving recess 25*b*, and holds the latch member 25 at the engaging position. When the latch member 25 is located at the release position of FIG. 2, the projection 21*a* of the second engaging portion 21 is engaged with the second receiving recess 25*c*, and holds the latch member 25 at the release position.

When the scissor piece 2 is rotated counter-clockwise from the first open position of FIG. 2 against the pressure of the first engaging portion 20 of the spine 6, the outer edge of the tongue 15 slides against the first engaging portion 20 while being pressed by the first engaging portion 20. As shown in FIG. 3, when the scissor piece 2 reaches the second open position, an internal corner (retaining portion) 15*b* located at the proximal end of the scissor piece 2 is engaged with the first engaging portion 20. The internal corner 15*b* includes two flat surfaces that intersect each other. The scissor piece 2 is prevented from rotating beyond the second open position by the engagement of the internal corner 15*b* with the first engaging portion 20, and is held at the second open position by the pressure elastically applied by the first engaging portion 20. The first engaging portion 20 functions as a lock member that engages with the scissor piece 2 to hold the scissor piece 2 at the second open position.

When the scissor piece 2 is rotated clockwise from the second open position of FIG. 3 against the pressure of the first engaging portion 20, the scissor piece 2 is returned to the first open position of FIG. 2 or the closed position of FIG. 1.

The scissor piece 2 has a finger catch hole 2*b* and a finger catch dent 2*c*. A user can easily rotate the scissor piece 2 by holding the scissor piece 2 at positions corresponding to the finger catch hole 2*b* or the finger catch dent 2*c*.

Next, a method for using the retractable scissors formed as described above will now be described. First, when the retractable scissors are in a non-use state, the scissor piece 2 is held at the closed position by the latch member 25 at the engaging position as shown in FIG. 1. When the latch member 25 is rotated to the release position from this state, the scissor piece 2 is rotated to the first open position of FIG. 2 by the pressure elastically applied by the first engaging portion 20 of the spine 6, and the retractable scissors become able to be used as a pair of scissors. That is, when the user rotates the scissor piece 2 against the pressure of the first engaging portion 20 from the first open position of FIG. 2 toward the closed position of FIG. 1, the intersection (contact portion) between the first edge 2*a* of the scissor piece 2 and the second edge 4*a* of the holder 1 starts to close, so that an object sandwiched between the edges 2*a*, 4*a* is cut. In this manner, when the scissor piece 2 is rotated from the first open position toward the closed position, the scissor piece 2 and the holder 1 (more specifically, the first side wall 4) cooperate to function as a pair of scissors that cuts the object between the first and second edges 2*a*, 4*a*.

When the scissor piece 2 is rotated from the closed position of FIG. 1 or the first open position of FIG. 2 to the second open position of FIG. 3, the retractable scissors can be used as a knife. That is, the scissor piece 2 functions as a blade of a knife, and the holder 1 functions as a handle of the knife.

The present embodiment described above has the following advantages.

In the state where the scissor piece 2 is rotated to the first open position, at which the scissor piece 2 is open with respect to the holder 1 at an acute angle, the scissor piece 2 and the holder 1 functions as a pair of scissors. In the state where the scissor piece 2 is rotated to the second open position, at which the scissor piece 2 is open with respect to the holder 1 wider than at the first open position, the scissor piece 2 functions as a blade of a knife, and the holder 1 functions as a handle of the knife. That is, the holder 1 having the function of storing the scissor piece 2 is used as one of the scissor pieces by impart, to the opening rim of the accommodation groove 1*a* of the holder 1, the function of the second edge 4*a* for cutting an object by cooperating with the first edge 2*a* of the scissor piece 2. As a result, the retractable scissors of the present embodiment nave both the function of knife and the function of scissors by merely providing two components including the holder 1 and the single scissor piece 2 that can be stored in the holder 1 as the main component. Therefore, the number of parts is reduced and the structure is simplified, so that the size and the manufacturing costs of the retractable scissors are reduced.

The first engaging portion 20, which is a part of the spine 6, functions as an urging member that urges the scissor piece 2 from the closed position toward the first open position, and also functions as a lock member that engages with the scissor piece 2 to hold the scissor piece 2 at the second open position. Therefore, a dedicated member for urging the scissor piece 2 and a dedicated member for holding the scissor piece 2 at a predetermined position are unnecessary. Thus, the number of parts is reduced and the structure is simplified.

The latch member 25 is provided at the proximal end of the holder 1. The latch member 25 is rotational between the engaging position, at which the latch member 25 engages with the scissor piece 2 to hold the scissor piece 2 at the closed position, and the release position, at which the latch member 25 is disengaged from the scissor piece 2. The second engaging portion 21, which is a part of the spine 6, functions to elastically engage with the latch member 25 to hold the latch member 25 at the engaging position and the release position. Therefore, a dedicated member for holding the latch member 25 at a predetermined position is unnecessary. This further reduces the number of parts and simplifies the structure.

The above described embodiment may be modified as follows.

Figure 6:
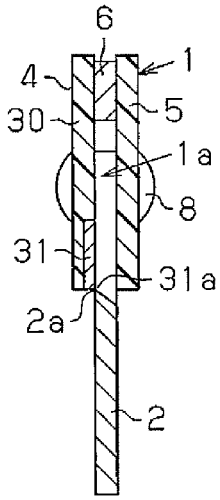
FIG. 6 is a cross-sectional view corresponding to FIG. 5 showing a modified embodiment of the scissors according to the present embodiment of FIGS. 1 to 5.

As shown in FIG. 5, in the above described embodiment, the first and second side walls 4, 5 forming the main body of the holder 1 are formed of a hard material such as a metallic material or ceramics, and the second edge 4*a* is formed on the main body of the holder 1 (more specifically, on the first side wall 4). That is, the main body of the holder 1 is formed of a material that is sufficient to function as the edge of the scissor piece. However, instead, the first side wall 4 may be constituted by a main body 30 and an edge forming member (liner) 31, which is formed of a different material from the main body 30 and has a second edge 31*a*, as shown in FIG. 6. In this case, the main body 30 is preferably formed of material that is insufficient to function as the edge of the scissor piece such as a synthetic plastic material or wood, and the edge forming member 31 is preferably formed of a hard material that is sufficient to function as the edge of the scissor piece such as a metallic material or ceramics. Also, the second side wall 5 may be formed of the same material as the main body 30 of the first side wall 4. In this case, the weight and the costs of the holder 1 are reduced, or the flexibility of design of the holder 1 is improved without deteriorating the function as a pair of scissors.

In the embodiment of FIGS. 1 to 5, the second side wall 5 of the holder 1 may be formed of material that is insufficient to function as the edge of the scissor piece such as a synthetic plastic material or wood.

In each of the embodiments of FIGS. 1 to 6, the second side wall 5 may be omitted. In this case, the first side wall 4 and the spine 6 form the holder 1. With this structure, when the scissor piece 2 is located at the closed position, one side of the scissor piece 2 is exposed to the outside. However, since at least the edge 2*a* is covered by the first side wall 4, the first side wall 4 sufficiently functions as the holder for storing the scissor piece 2.

In each of the embodiments of FIGS. 1 to 6, the scissor piece 2 may be formed to be rotational between only the closed position of FIG. 1 and the first open position of FIG. 2, and not to rotate to the second open position of FIG. 3. In this case, the retractable scissors do not function as a knife, but functions as retractable scissors by merely providing two components including the holder 1 and the single scissor piece 2, which can be stored in the holder 1, as the main component (that is, unlike the prior art, without requiring two blades separate from the holder). In this case, the first edge 2*a* of the scissor piece 2 may be formed to be able to at least cut an object between the first edge 2*a* and the second edge 4*a* of the first side wall 4, and does not need to be sharpened enough to function as a blade of a knife.

In each of the embodiments of FIGS. 1 to 6, at least one of the urging member that urges the scissor piece 2 from the closed position toward the first open position and the lock member that engages with the scissor piece 2 to hold the scissor piece 2 at the second open position may be formed of an independent member separate from the spine 6.

In each of the embodiments of FIGS. 1 to 6, the urging member that urges the scissor piece 2 from the closed position toward the first open position may be omitted. In this case, when using the retractable scissors as a pair of scissors, the scissor piece 2 needs to be manually moved between the closed position of FIG. 1 and the first open position of FIG. 2 along the entire distance. Thus, to facilitate such manual operation, a manipulation piece is preferably provided on the proximal end of the scissor piece 2 to extend in the opposite direction from the distal end of the scissor piece 2, and the same manipulation piece is preferably provided on the holder 1.

In each of the embodiments of FIGS. 1 to 6, the structures of the latch member 25 and the second engaging portion 21, which is engaged with the latch member 25, may be changed as required. For example, the second engaging portion 21 may be formed by an independent member separate from the spine 6.

Although the multiple embodiments have been described herein, it will be clear to those skilled in the art that the present invention may be embodied in different specific forms without departing from the spirit of the invention. The invention is not to be limited to the details given herein, but may be modified within the scope and equivalence of the appended claims.

The invention claimed is:

1. Retractable scissors comprising:

a holder;

a scissor piece mounted on the holder, the scissor piece being rotational with respect to the holder between a closed position, at which the scissor piece is retracted in the holder, and an open position, at which the scissor piece is open with respect to the holder;

an urging member that urges the scissor piece from the closed position toward the open position, the holder including a spine, and the urging member comprising part of the spine having elasticity; and a latch member detachably engaged with the scissor piece to hold the scissor piece at the closed position wherein the scissor piece includes a first edge, the holder includes a second edge that intersects and contacts the first edge, and when the scissor piece is rotated with respect to the holder from the open position toward the closed position, the scissor piece and the holder cooperates to function as a pair of scissors that cuts an object between the first and second edges.

2. The retractable scissors according to claim 1, wherein the holder includes first and second side walls, which face each other to define an accommodation groove therebetween, when the scissor piece is located at the closed position, the scissor piece is retracted in the accommodation groove, and the second edge is provided on the first side wall and defines part of an opening rim of the accommodation groove.

3. The retractable scissors according to claim 1, wherein the open position is a first open position, at which the scissor piece is open with respect to the holder at an acute angle, the scissor piece is rotational to a second open position, at which the scissor piece is open with respect to the holder wider than at the first open position, and when the scissor piece is located at the second open position, the scissor piece functions as a blade of a knife, and the holder functions as a handle of the knife.

4. The retractable scissors according to claim 1, wherein the latch member is supported on the holder to be rotational between an engaging position, at which the latch member engages with the scissor piece, and a release position, at which the latch member is disengaged from the scissor piece.

5. The retractable scissors according to claim 1, wherein the holder includes a main body and an edge forming member, which is formed of a different material from the main body and includes the second edge.

6. Retractable scissors comprising:

a holder:

a scissor piece mounted on the holder, the scissor piece being rotational with respect to the holder between a closed position, at which the scissor piece is retracted in the holder, and an open position, at which the scissor piece is open with respect to the holder; and a latch member detachable engaged with the scissor piece to hold the scissor piece at the closed position, wherein the scissor piece includes a first edge, the holder includes a second edge that intersects and contacts the first edge, when the scissor piece is rotated with respect to the holder from the open position toward the closed position, the scissor piece and the holder cooperates to function as a pair of scissors that cuts an object between the first and second edges, the latch member is supported on the holder to be rotational between an engaging position, at which the latch member engages with the scissor piece, and a release position, at which the latch member is disengaged from the scissor piece, and the holder includes a spine, and part of the spine functions as an engaging portion, which elastically engages with the latch member to selectively hold the latch member at the engaging position and the release position.

7. A retractable scissors comprising:

a holder including first and second side walls, which face each other to define an accommodation groove therebetween; and a scissor piece mounted on a distal end of the holder, the scissor piece being rotational with respect to the holder among a closed position, at which the scissor piece is retracted in the accommodation groove, a first open position, at which the scissor piece is open with respect to the holder at an acute angle, and a second open position, at which the scissor piece is open with respect to the holder wider than at the first open position;

an urging member that urges the scissor piece from the closed position toward the first open position, the holder including a spine arranged between the first and second side walls, and a distal end of the spine having elasticity and containing the urging member; and a latch member detachably engaged with the scissor piece to hold the scissor piece at the closed position, wherein the scissor piece includes a first edge, the holder includes a second edge that intersects and contacts the first edge, the second edge is provided on the first side wall and defines part of an opening rim of the accommodation groove, when the scissor piece is rotated with respect to the holder from the first open position toward the closed position, the scissor piece and the holder cooperate to function as a pair of scissors that cuts an object between the first and second edges, and when the scissor piece is located at the second open position, the scissor piece functions as a blade of a knife, and the holder functions as a handle of the knife.

8. The retractable scissors according to claim 7, wherein the distal end of the spine further functions as a lock member, which engages with the scissor piece to hold the scissor piece at the second open position.

9. The retractable scissors according to claim 7, wherein the latch member is supported on the holder to be rotational between an engaging position, at which the latch member engages with a distal end of the scissor piece, and a release position, at which the latch member is disengaged from the scissor piece.

10. The retractable scissors according to claim 9, wherein a proximal end of the spine functions as an engaging portion, which elastically engages with the latch member to selectively hold the latch member at the engaging position and the release position.

11. The retractable scissors according to claim 7, wherein the first side wall includes a main body and an edge forming member, which is formed of a different material from the main body and includes the second edge.

* * * * *